US007222429B2

(12) United States Patent
PerMar, Jr.

(10) Patent No.: US 7,222,429 B2
(45) Date of Patent: May 29, 2007

(54) LOCKING FOLDING KNIFE AND ASSOCIATED METHODS

(76) Inventor: John W. PerMar, Jr., 630 Dartmouth St., Orlando, FL (US) 32804

( * ) Notice: Subject to any disclaimer, the term of this patent is extended or adjusted under 35 U.S.C. 154(b) by 239 days.

(21) Appl. No.: 10/764,350

(22) Filed: Jan. 23, 2004

(65) Prior Publication Data

US 2004/0148781 A1 Aug. 5, 2004

Related U.S. Application Data

(60) Provisional application No. 60/443,154, filed on Jan. 28, 2003.

(51) Int. Cl.
*B26B 1/04* (2006.01)
*B26B 1/02* (2006.01)
*B26B 1/10* (2006.01)

(52) U.S. Cl. ..... 30/161; 30/155; 30/159; 30/160

(58) Field of Classification Search ..... 30/160, 30/161, 151, 155, 158, 159, 330, 331, 337, 30/342; 7/118
See application file for complete search history.

(56) References Cited

U.S. PATENT DOCUMENTS 1,056,081 A * 3/1913 Yerzley ..... 30/155
1,189,005 A * 6/1916 Seely ..... 30/308.2
4,811,486 A * 3/1989 Cunningham ..... 30/161
5,095,624 A * 3/1992 Ennis ..... 30/161
5,615,484 A * 4/1997 Pittman ..... 30/161
5,685,079 A * 11/1997 Brothers et al. ..... 30/161
5,822,866 A * 10/1998 Pardue ..... 30/161
5,826,340 A * 10/1998 Hull ..... 30/161
6,675,484 B2 * 1/2004 McHenry et al. ..... 30/161
2002/0000042 A1 * 1/2002 Glesser et al. ..... 30/160
2005/0044717 A1 * 3/2005 Nishihara ..... 30/161

* cited by examiner

*Primary Examiner*—Boyer D. Ashley
*Assistant Examiner*—Edward Landrum
(74) *Attorney, Agent, or Firm*—Mark R. Malek; The Torpy Group, P.L.

(57) ABSTRACT

A folding knife includes a handle having a distal portion and a proximal portion, and a blade rotatably connected to the distal portion of the handle. The blade may be moveable between an opened position and a closed position, and may have at least one lock member receiving recess formed therein. The folding knife may further include a lock bar pivotally connected to a medial portion of the handle and moveable between an engaged position and a disengaged position. The lock bar may include a lock member which contacts a respective portion of the blade adjacent the lock member receiving recess to define a contact point between the lock member and the blade when the blade is in the opened position and the lock bar is in the engaged position. The folding knife may also include a lock pin connected to the handle adjacent the lock member.

19 Claims, 7 Drawing Sheets

LOCKING FOLDING KNIFE AND ASSOCIATED METHODS

RELATED APPLICATIONS

This application claims the benefit of U.S. Provisional Patent Application Ser. No. 60/443,154 filed on Jan. 28, 2003, the entire disclosure of which is incorporated herein by reference.

FIELD OF THE INVENTION

The present invention relates to the field of knives and, more particularly, to folding knives having locking mechanisms, and related methods.

BACKGROUND OF THE INVENTION

A folding knife may generally include a lock mechanism to keep the blade of the knife in a locked position when open. This may be helpful to reduce the possibility of the blade accidentally closing on a user's hand during use. For example, U.S. Pat. No. 5,826,340 to Hull discloses a traditional lock mechanism for a folding knife.

The knife includes a lock bar that is pivotally connected to a handle, adjacent the blade. The lock bar includes one lock member, and the blade includes a lock member receiving recess. The lock member includes a bottom wall, and two sidewalls that extend upwardly therefrom. The lock member receiving recess is defined by a bottom wall, and a pair of opposing sidewalls that extend upwardly therefrom. When the blade is in an opened position, the opposing sidewalls of the lock member matingly engage the respective opposing sidewalls of the lock member receiving recess. In other words, when the blade is in the opened position, respective surfaces of the lock member and the lock member receiving recess are in contact with one another.

This type of lock mechanism may, however, be prone to accidental unlocking by the user. Another problem that may occur with this type of lock mechanism is lock failure when a force is applied to a distal portion of the blade.

Another type of folding knife is illustrated in U.S. Pat. No. 5,615,484 to Pittman. This type of folding knife includes a lock mechanism having a stop pin and a slide member that engages the stop pin. When the blade is in the opened position, the stop pin contacts a notch formed in the end of the blade. The stop pin also contacts a sidewall of the slide member when the blade is in the opened position, and the slide member is in an engaged position. To return the blade to the closed position, the slide member is disengaged from contact with the stop pin, allowing the blade to be freely closed. This type of lock mechanism may also be disadvantageous because it may be prone to accidental unlocking by the user.

SUMMARY OF THE INVENTION

In view of the foregoing background, it is therefore an object of the present invention to provide a folding knife that more readily locks a blade in an opened position.

This and other objects, features, and advantages of the present invention are provided by a folding knife comprising a handle having a distal portion and a proximal portion. The proximal portion may have a recess formed therein. The folding knife may also include a blade rotatably connected to the handle, a lock bar pivotally connected to the handle, and a lock pin between the blade and the handle for readily locking the blade in an opened position.

More particularly, the blade may be rotatably connected to the distal portion of the handle and moveable between an opened position and a closed position. The blade may have at least one lock member receiving recess formed therein and may include an upper edge and a lower sharpened edge.

The lock bar may be pivotally connected to a medial portion of the handle and moveable between an engaged position and a disengaged position. The lock bar may comprise at least one lock member, a portion of which contacts a respective portion of the blade adjacent the lock member receiving recess to define a contact point between the lock member and the blade when the blade is in the opened position. The folding knife may further comprise a lock pin connected to the handle adjacent the lock member.

The lock member receiving recess may include a first and a second lock member receiving recess. The first lock member receiving recess may be defined by a bottom wall and first and second opposing sidewalls extending upwardly therefrom. The second lock member receiving recess is adjacent the first lock member receiving recess and may be defined by a bottom wall and a sidewall extending upwardly therefrom.

The lock member may comprise a first lock member and a second lock member. The first lock member may be defined by a bottom wall and first and second sidewalls extending upwardly therefrom. The second lock member is adjacent the first lock member and may be defined by a bottom wall and a sidewall extending upwardly therefrom.

The bottom wall and sidewall of the second lock member may be spaced apart from the bottom wall and sidewall of the second lock member receiving recess when the lock bar is in the engaged position.

The lock pin may be connected to the handle adjacent the first and second lock members so that when the blade is in the opened position, the lock pin contacts the second sidewall of the first lock member, and the bottom wall of the second lock member receiving recess. Further, the sidewall of the second lock member receiving recess may be spaced apart from the lock pin and from the sidewall of the second lock member when the blade is in the opened position. Accordingly, the configuration of the lock member, the lock member receiving recesses, and the lock pin advantageously provides a more reliable lock when the blade is in the opened position, and when the lock bar is in the engaged position.

The folding knife may further comprise a lock bar spring member connected to the handle to engage a portion of the lock bar. The lock bar spring member advantageously provides resistance to the movement of the lock bar to reduce the risk of a user accidentally moving the lock bar to the disengaged position.

The folding knife may also comprise a blade connecting member connected to the handle. The blade may comprise a blade connecting member passageway for receiving the blade connecting member to thereby rotatably connect the blade to the handle. The folding knife may further comprise a lock bar connecting member connected to the handle. The lock bar may have a lock bar connecting member passageway formed therein for receiving the lock bar connecting member to thereby pivotally connect the lock bar to the handle.

The first lock member receiving recess may be U-shaped, and the second lock member receiving recess may be L-shaped. The sharpened lower edge may be adjacent a lower edge of the lock bar when the blade is in the closed position. This advantageously provides a barrier to the sharpened lower edge of the blade when in the closed position.

A method aspect of the present invention is for locking a folding knife in an opened position. The method may comprise moving the blade to the opened position, and moving the lock bar to the engaged position so that a portion of the lock member contacts a respective portion of the blade adjacent the lock member recess to thereby define a contact point between the lock member and the blade when the blade is in the opened position.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime, double prime, and triple prime notations are used to indicate similar elements in alternate embodiments.

Figure 1:
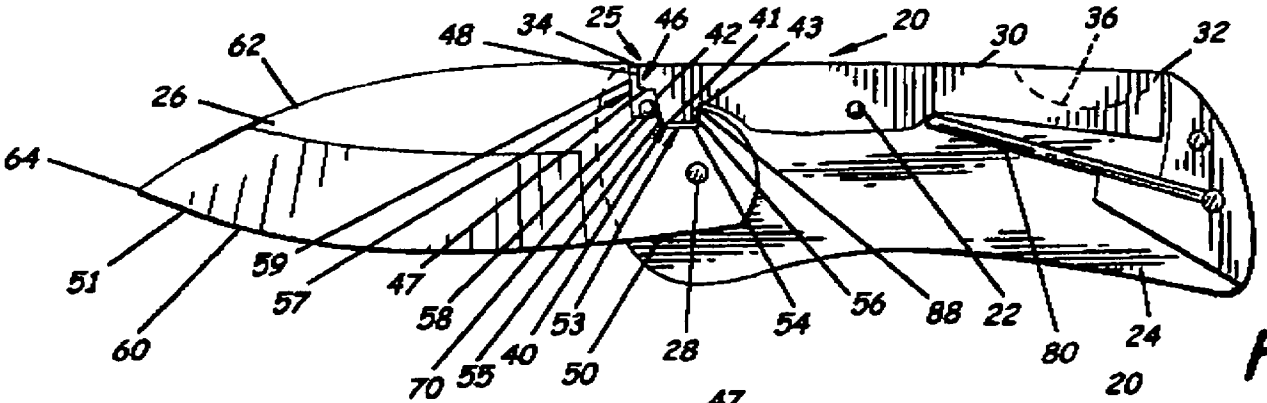
FIG. 1 is a side elevational view of a folding knife according to the present invention.
Figure 2:
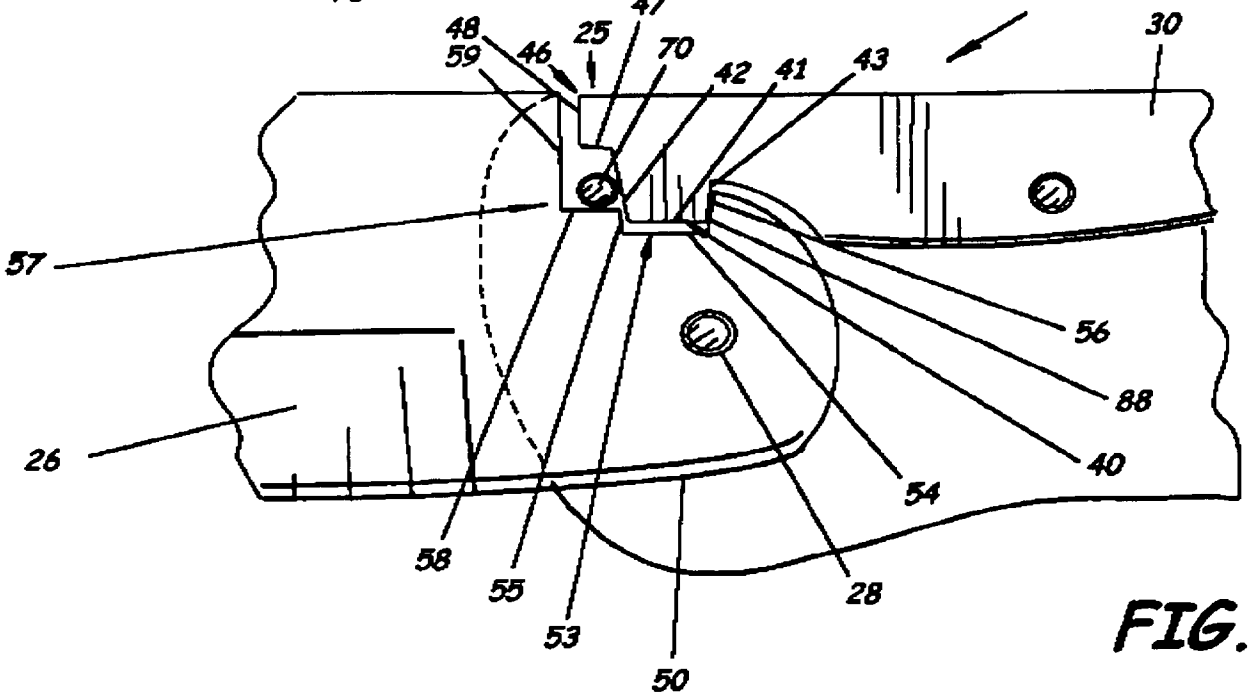
FIG. 2 is an enlarged partial side elevational view of the folding knife shown in FIG. 1.
Figure 3:
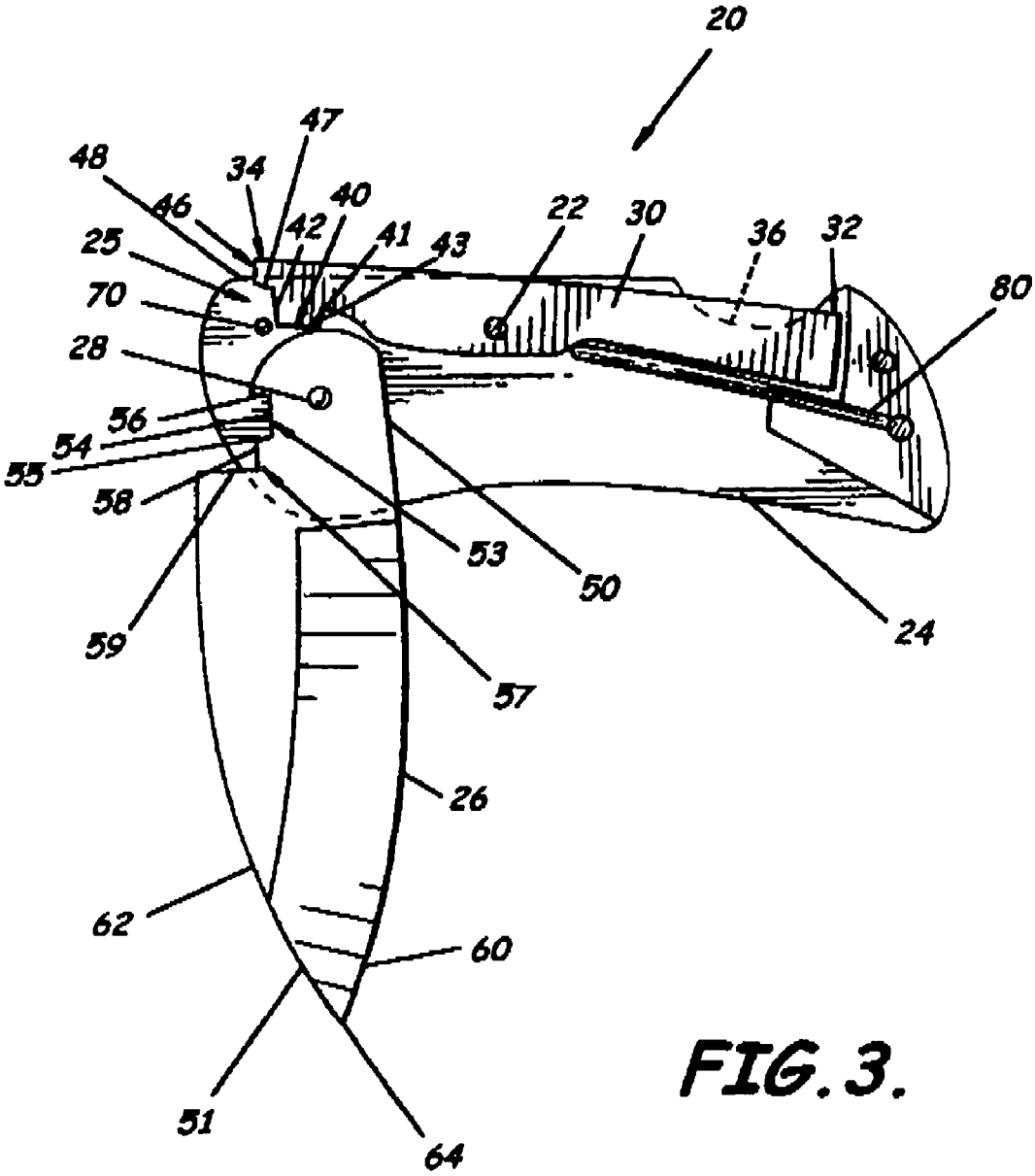
FIG. 3 is a side elevational view of the folding knife shown in FIG. 1 with the blade being moved between an opened and a closed position.
Figure 4:
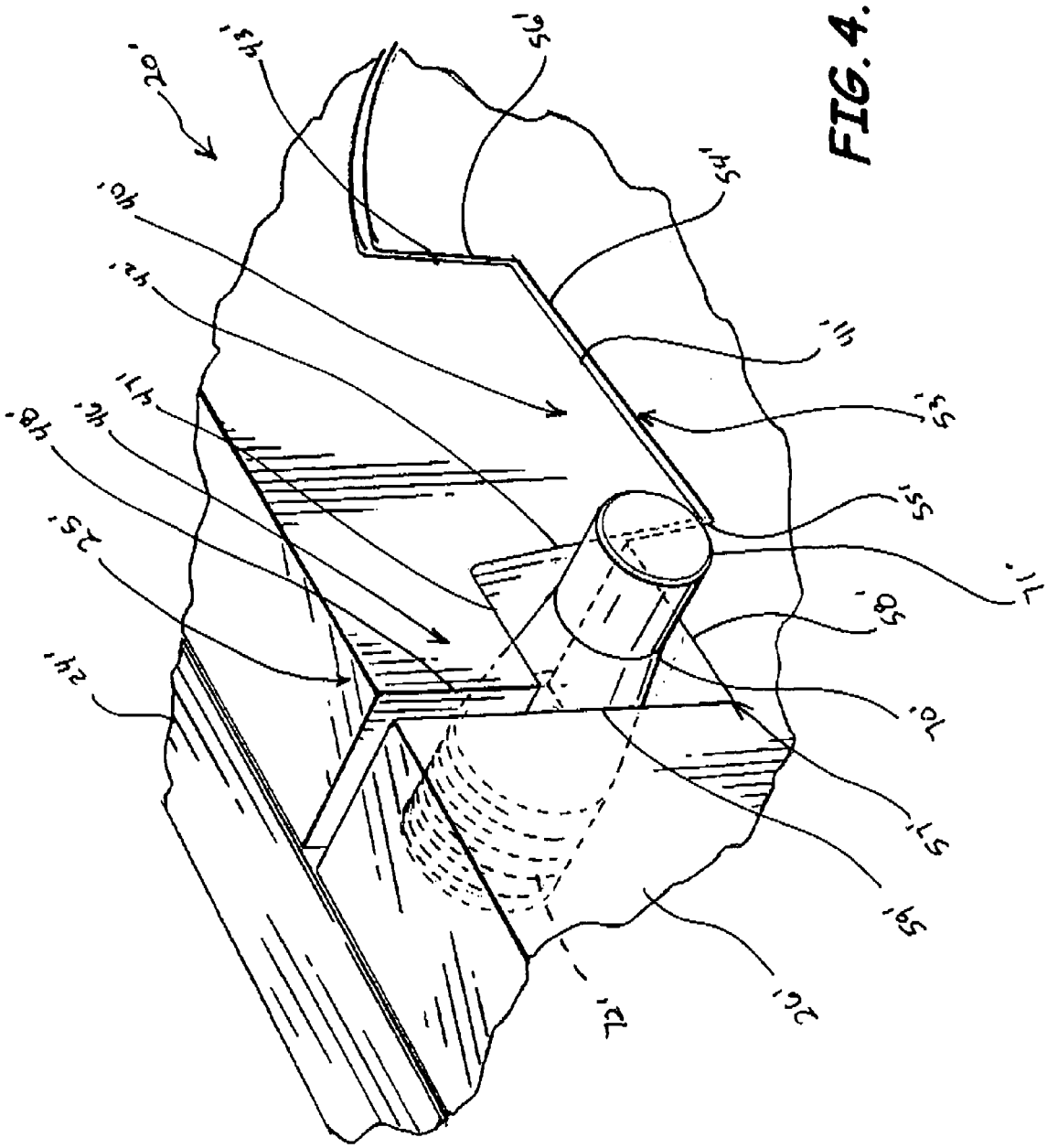
FIGS. 4-6 are partial perspective views of another embodiment of the folding knife according to the present invention.
Figure 5:
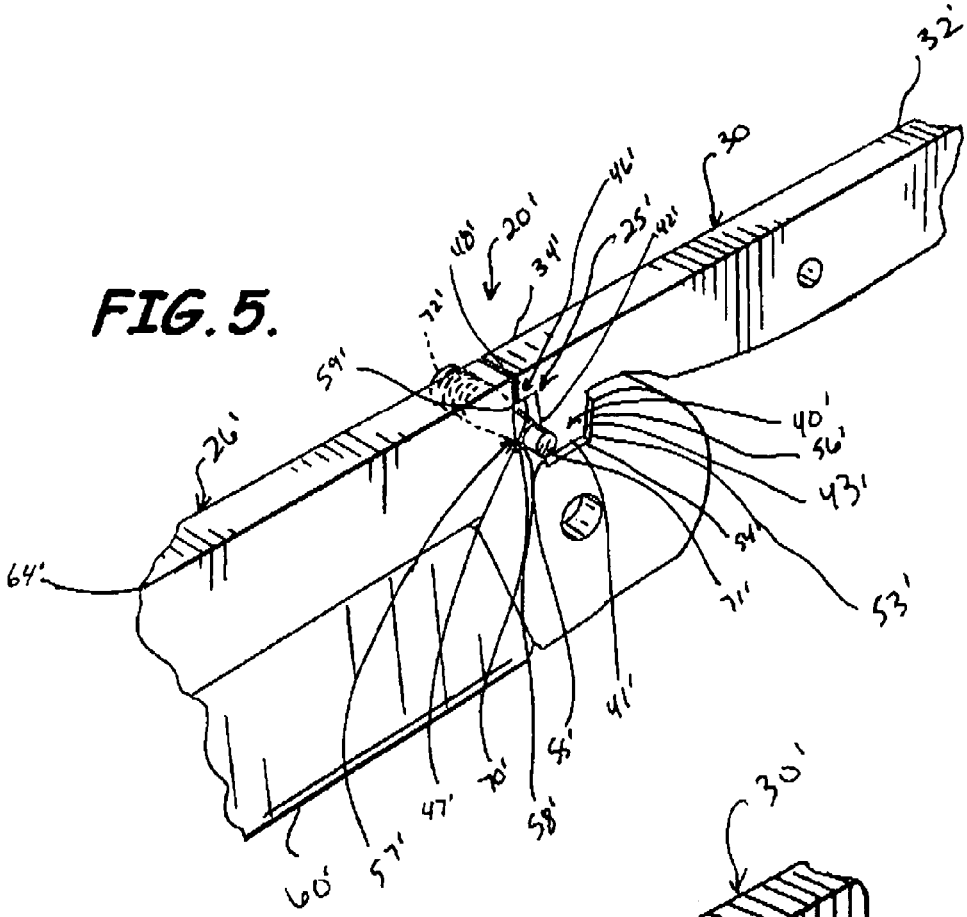
Figure 6:
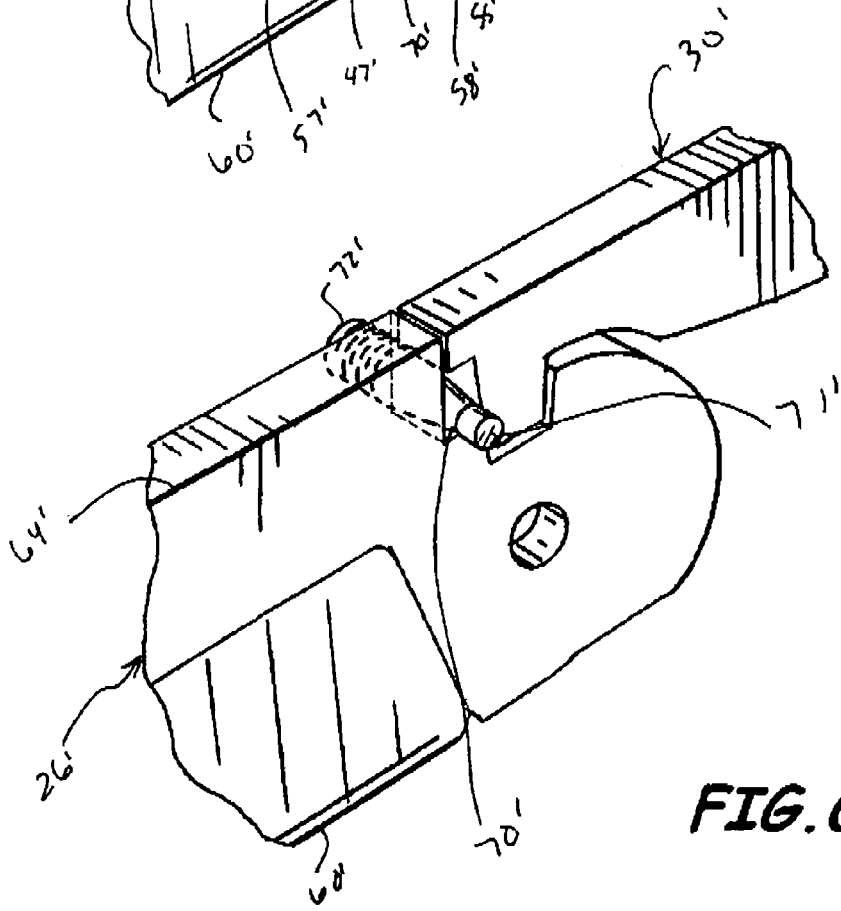

Referring initially to FIGS. 1-3, a first embodiment of a folding knife 20 according to the present invention is now described. In FIGS. 1 and 2, the folding knife 20 is illustrated in an opened position. In FIG. 3, the folding knife 20 is illustrated as being moved between an opened position and a closed position. More specifically, the folding knife 20 includes a front cover and a rear cover, but is illustrated in FIGS. 1-3 without the front cover for clarity.

The folding knife 20 illustratively includes a handle 24, and a blade 26 rotatably connected to the handle. The blade 26 is moveable between an opened position and a closed position, and includes a proximal end portion 50 and a distal end portion 51.

The folding knife 20 also includes a blade connecting member 28 connected to the handle 24. The blade 26 also has a blade connecting member passageway formed therein. The blade connecting member passageway may receive the blade connecting member 28 to rotatably connect the blade 26 to the handle 24. The blade connecting member 28 may be a blade connecting pin, for example, or any other type of connector that rotatably connects the blade 26 to the handle 24, as understood by those skilled in the art. The blade connecting member 28 acts as an axis of rotation about which the blade 26 rotates when being moved from the opened position to the closed position.

The blade 26 illustratively includes a lock member receiving recess, which includes a first lock member receiving recess 53 formed in the proximal end portion 50 thereof. The first lock member receiving recess 53 is defined by a bottom wall 54, and a first and second opposing sidewalls 56, 55 extending upwardly therefrom. The lock member receiving recess may also illustratively includes a second lock member receiving recess 57. The second lock member receiving recess 57 is adjacent the first lock member receiving recess 53 and defined by a bottom wall 58 and a sidewall 59 extending upwardly therefrom. The first lock member receiving recess 53 may be a U-shaped recess, and the second lock member receiving recess 57 may be an L-shaped recess, for example.

The folding knife 20 also includes a lock bar 30 pivotally connected to the handle 24. More specifically, the lock bar 30 is moveable between an engaged position and a disengaged position. The folding knife 20 includes a lock bar connecting member 22 connected to the handle 24. Further, the lock bar 30 has a lock bar connecting member passageway formed therein. The lock bar connecting member passageway receives the lock bar connecting member 22 to pivotally connect the lock bar 30 to the handle 24. The lock bar connecting member 22 may be provided by a lock bar connecting pin, for example, or another type of connecting member suitable for pivotally connecting the lock bar 30 to the handle 24.

The lock bar 30 is elongate and has a proximal end portion 32 and a distal end portion 34. The lock bar 30 also includes a lock member 25 along the distal end portion 34 thereof. The lock member 25 includes a first lock member 40 defined by a bottom wall 41 and first and second sidewalls 43, 42 extending upwardly therefrom. More specifically, the first lock member 40 extends downwardly from a lower edge of the lock bar 30.

The lock member 25 also includes a second lock member 46 adjacent the first lock member 40. The second lock member 46 is defined by a bottom wall 47 and a sidewall 48 extending upwardly therefrom. The bottom wall 47 of the second lock member 46 illustratively contacts the second sidewall 42 of the first lock member 40 to form an L-shape.

As illustrated in FIGS. 1 and 2, the lock bar 30 is preferably in an engaged position when the blade 26 is in the opened position. As illustrated in FIG. 3, the lock bar 30 is moved from the engaged position to the disengaged position to move the blade 26 from the opened position to the closed position. When the blade 26 is in the opened position, a portion of the first sidewall 43 of the first lock member 40 contacts a portion of the first sidewall 56 of the first lock member recess 53 to define a contact point 88 between the lock bar 30 and the blade 26.

The folding knife 20 further illustratively comprises a lock pin 70 connected to the handle 24 adjacent the first and second lock members 40, 46 so that when the blade 26 is in the opened position, the lock pin contacts the second sidewall 42 of the first lock member 40 and the bottom wall 58 of the second lock member receiving recess 57. Accordingly, the second lock member 46 may be a lock pin cover member, for example.

As perhaps best illustrated in FIGS. 1 and 2, the bottom wall 47 and sidewall 48 of the second lock member 46 are spaced apart from the bottom wall 58 and sidewall 59 of the second lock member receiving recess 57 when the lock bar 30 is in the engaged position. The sidewall 59 of the second lock member receiving recess 57 is also spaced apart from the lock pin 70 when the blade 26 is in the opened position.

As further illustrated in FIGS. 1 and 2, when the blade 26 is in the opened position, the lock pin 70 illustratively contacts the bottom wall 58 of the second lock member receiving recess 57, and also contacts the second sidewall 42 of the first lock member 40. Further, the sidewall 59 of the second lock member receiving recess 57 is spaced apart from the sidewall 48 of the second lock member 46 when the blade 26 is in the opened position. Accordingly, when the blade 26 is in the opened position, and the lock bar 30 is in the engaged position, the lock pin 70 contacts portions of the blade and portions of the lock bar to advantageously provide additional lock stability to the blade.

This configuration further advantageously reduces the risk of the blade 26 inadvertently being moved to the closed position due to lock failure. The contact of the lock pin 70 with the second sidewall 42 of the first lock member 40 advantageously causes the first lock member to be wedged between the lock pin and the first sidewall 56 of the first lock member receiving recess 53 to thereby enhance the strength of the lock member 25. In other words, the lock pin 70 enhances the lock strength associated with contact between the lock bar 30 and the blade 26 when the blade is in the opened position, and the lock bar is in the engaged position.

Those skilled in the art will appreciate that the second lock member 46 is not necessary for the blade 26 to be locked in place when in the open position. More specifically, the folding knife 20 may be readily used to lock the blade 26 in the open position without the use of the second lock member 46. This is possible because of the configuration of the lock pin 70. In other words, if a force is applied to the distal end 51 of the blade 26 while the lock bar 30 is in the engaged position, the second sidewall 42 of the first lock member 40 would contact the lock pin 70, and cause the first lock member to be wedged in the first lock member receiving recess 53, thereby enhancing the strength of the lock member 25. More specifically, the lock strength associated with contact between the lock bar 30 and the blade 26 may advantageously be greatly enhanced.

The blade 26 illustratively comprises an upper edge 62, and a lower edge 60. The lower edge 60 may be a sharpened lower edge. The upper edge 62 and the lower edge 60 of the blade 26 extend from the proximal end portion 50 of the blade initially spaced from one another, to the distal end portion 51 of the blade, where the upper edge and the lower edge of the blade meet to form a tip 64. The upper edge 62 of the blade 26 may include portions that are sharpened.

In other embodiments, however, the upper edge 62 of the blade 26 may remain completely unsharpened, or completely sharpened, as understood by those skilled in the art. The upper edge 62 of the blade 26 may also be serrated, for example, or have any other type of finish, as understood by those skilled in the art. The sharpened lower edge 60 of the blade 26 is illustratively adjacent a lower edge of the lock bar 30 when the blade is in the closed position.

A recess 36 may be formed in a proximal end portion 32 of the handle 24. The recess 36 allows a user to access the proximal end 32 of the lock bar 30 to move the lock bar between the engaged and the disengaged positions.

The folding knife 20 may also comprise a lock bar spring member 80 connected to the handle 24 to engage a portion of the lock bar 30. When a user depresses the lock bar 30 along the recess 36 in the handle 24, the spring member 80 provides a predetermined amount of resistance. Further, upon releasing the lock bar 30 adjacent the recess 36 in the handle 24, the resistance provided by the spring member 80 returns the lock bar to the engaged position. It should be noted that the lock bar 30 is generally in the engaged position, and is moved to the disengaged position when moving the blade 26 between the opened and closed positions.

The blade 26, handle 24, lock bar 30, spring member 80, lock bar connecting member 22, blade connecting member 28, and lock pin 70 may all be made of high strength, light weight material, such as stainless steel, for example, or any other type of material having similar high strength properties, as understood by those skilled in the art.

Referring now additionally to FIGS. 4-7, a second embodiment of the folding knife 20' is now described. In the second embodiment of the folding knife 20', the lock pin 70' illustratively includes a first end 71' and a second end 72'. The first end 71' of the lock pin 70' may be tapered. The second end 72' of the lock pin 70', which opposes the first end 71' of the lock pin, may be threaded.

Figure 7:
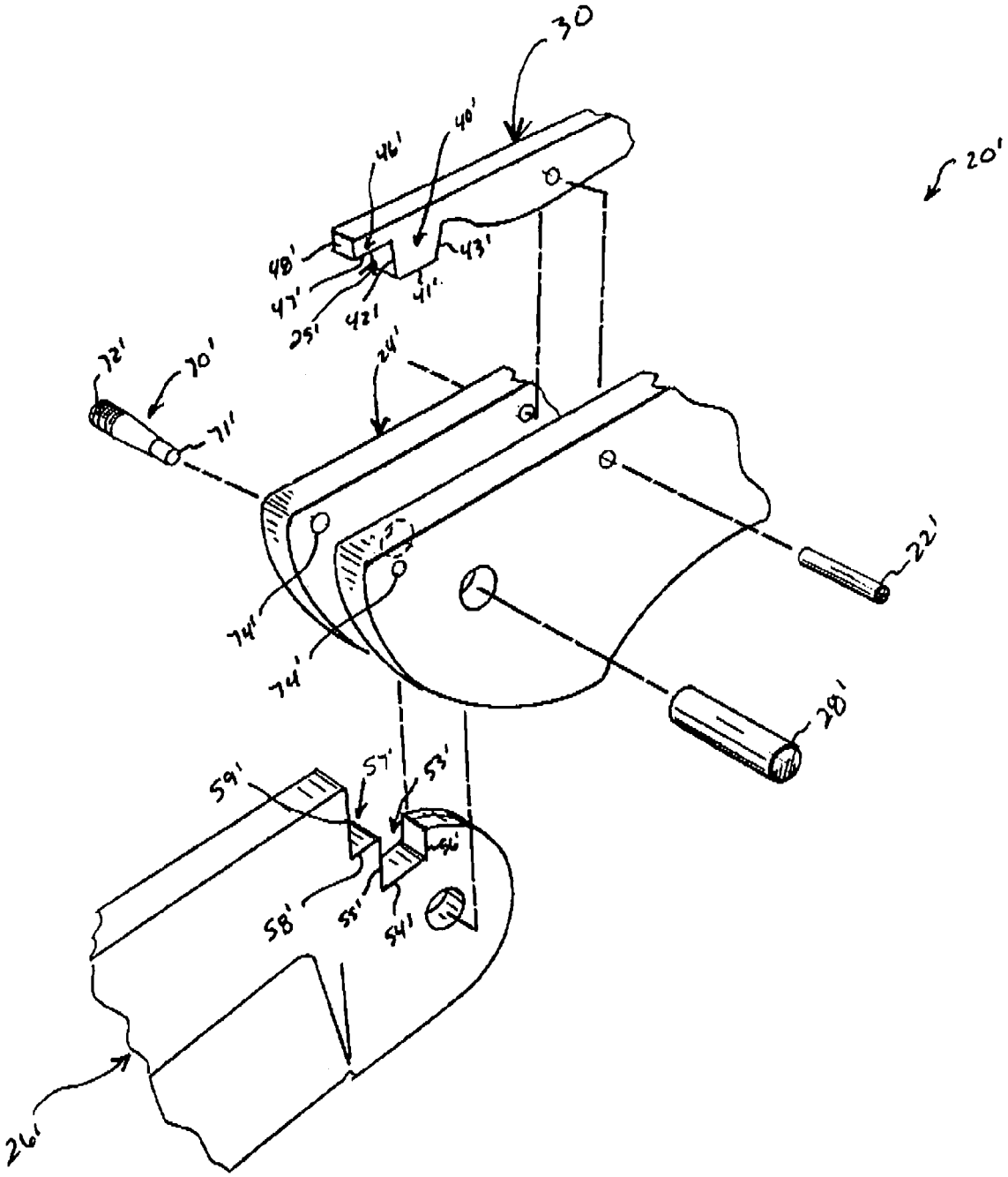
FIG. 7 is an exploded partial perspective view of the embodiment of the folding knife as shown in FIGS. 4-6.

Referring now more specifically to the exploded view of the folding knife 20' illustrated in FIG. 7, the second embodiment of the invention is now described in greater detail. The handle 24' of the folding knife 20' may further include a lock pin receiving passageway 74' formed therein. The lock pin receiving passageway 74' may also be threaded to threadingly receive the second end 72' of the lock pin 70'. More specifically, the tapered end of the lock pin 70' may advantageously be readily inserted through the lock pin receiving passageway 74' to a point where the second end 72' of the lock pin engages the threaded portion of the lock pin receiving passageway. Accordingly, a user may turn the lock pin 70' in a predetermined direction to secure the lock pin in the lock pin receiving passageway 74'.

The tapered and threaded lock pin 70' advantageously allows a user to adjust the tension of the lock strength to be compensated for ware, when needed. Further, the tapered and threaded lock pin 70' advantageously allows a user to adjust positioning within the lock pin receiving recess 74'. The other elements of the second embodiment of the folding knife 20' are similar to those of the first embodiment, are labelled with prime notation, and require no further discussion herein.

Figure 9:
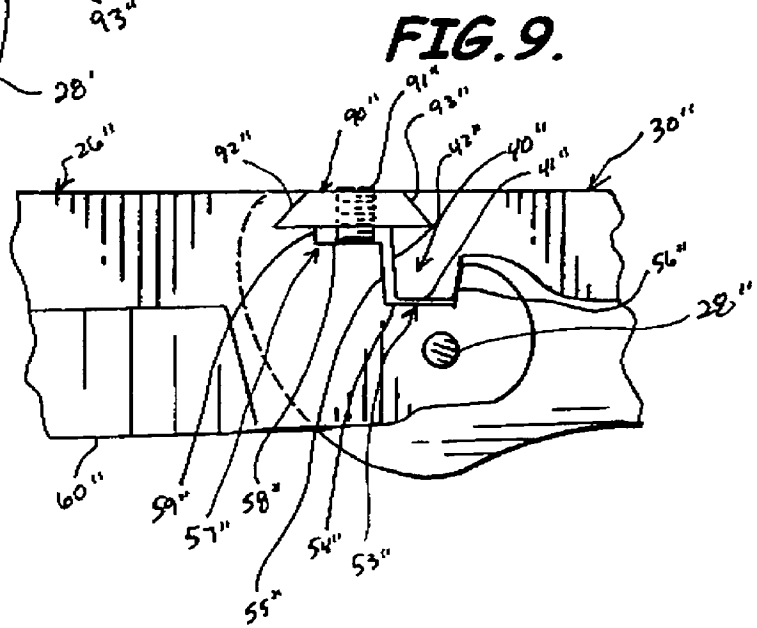
FIG. 9 is a side elevational view of the embodiment of the folding knife shown in FIG. 8.
Figure 8:
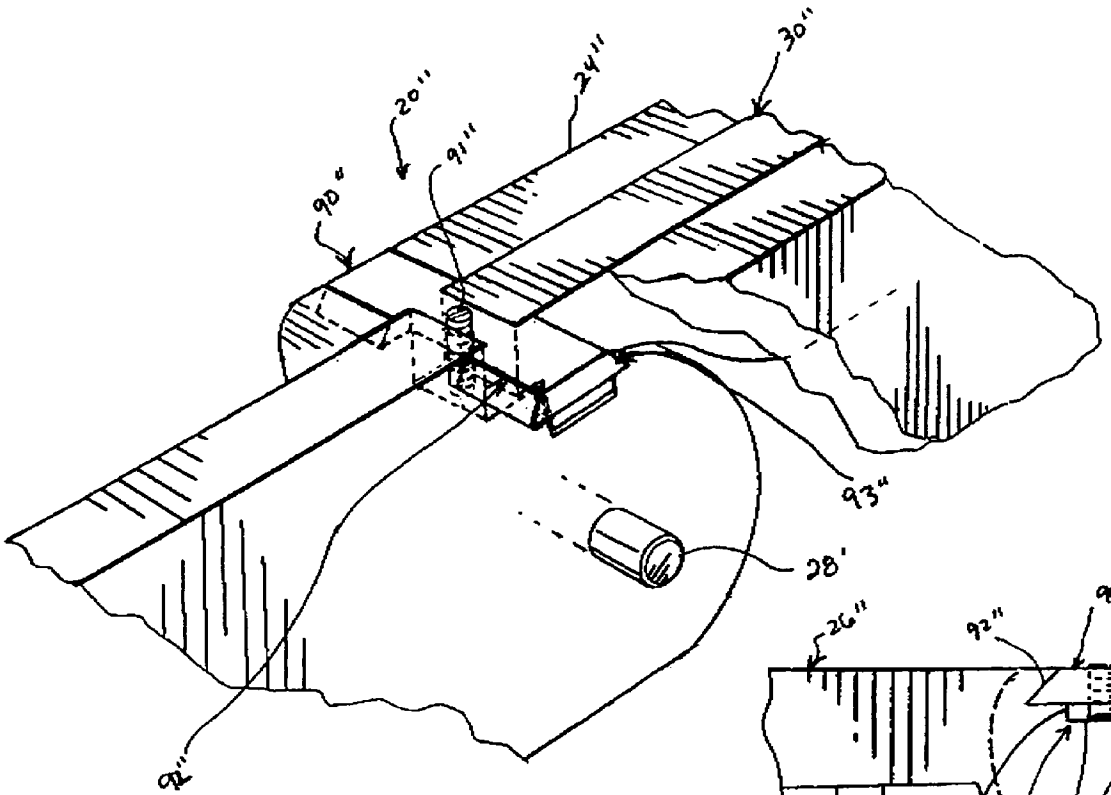
FIG. 8 is a partial perspective view of yet another embodiment of the folding knife according to the present invention.

Referring now additionally to FIGS. 8 and 9, a third embodiment of the folding knife 20" is now described in greater detail. The third embodiment of the folding knife 20" illustratively includes a lock bridge 90". The blade 26" of the third embodiment of the folding knife 20" has a first lock member receiving recess 53" and a second lock member receiving recess 57" formed therein.

The lock bar 30" of the second embodiment of the folding knife 20" includes a lock member 40". The lock bridge 90" may have an H-shape so that a medial portion of a first side 92" of the lock bridge may contact the sidewall 42" of the lock member 40", and so that a medial portion of the second side 93" of the lock bridge is adjacent to the sidewall 59" of the second lock member receiving recess 57" when the blade 26" is in the opened position. More specifically, the medial portion of the second side 93" of the lock bridge 90" is spaced apart from the sidewall 59" of the second lock member receiving recess 57".

The lock bridge 90" may have a trapezoidal shape, but may also have another shape suitable for contacting portions of the lock bar 30" when the lock bar is in the engaged position, as understood by those skilled in the art. The lock bridge 90" further illustratively includes a set screw 91" and a set screw receiving passageway formed therein. Both the set screw 91" and the set screw receiving passageway are preferably threaded to thereby engage one another when turning the set screw to position the blade 26" to a desired height.

A bottom portion of the set screw 91" may contact the bottom wall 58" of the second lock member receiving recess 57" when the blade 26" is in the opened position. The height of the blade 26" may advantageously be adjusted by a user using the set screw 91". The lock bridge 90" eliminates the need for the lock pin 70, 70' disclosed in the first and second embodiments of the folding knife 20, 20'.

The lock bridge 90" advantageously enhances the lock strength of the folding knife 20" associated with contact between the lock bar 30", the set screw 91", and the blade 26" when the blade is in the opened position and the lock bar is in the engaged position. The other elements of the third embodiment of the folding knife 20" are similar to those of the first embodiment, are labelled with double prime notation, and require no further discussion herein.

Figure 10:
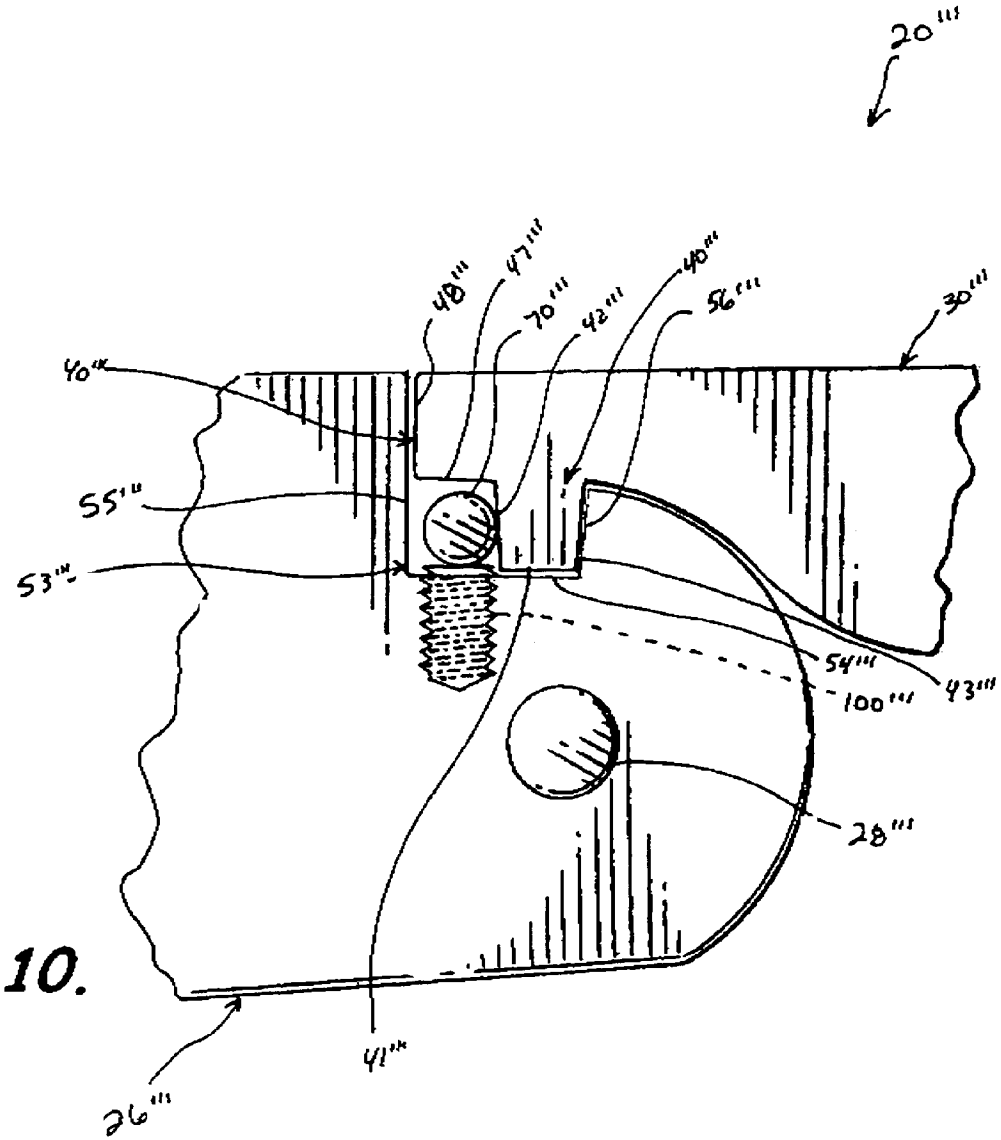
FIG. 10 is a partial side elevational view of still another embodiment of the folding knife according to the present invention.

Turning now additionally to FIG. 10, a fourth embodiment of the folding knife 20''' is now described. The fourth embodiment of the folding knife 20''' illustratively includes a lock pin 70''', and a lock bar 30''' including a first lock member 40''' and a second lock member 46'''. The blade 26''' illustratively includes a first lock member receiving recess 53''' defined by a bottom wall 54''', and first and second opposing sidewalls 55''', 56''', extending upwardly therefrom.

The fourth embodiment of the folding knife 20''' further illustratively includes a blade set screw 100''' for setting a desired height of the blade 26'''. The blade 26''' further has a blade set screw passageway formed in the bottom wall 54''' of the first lock member receiving recess 53''' for receiving the blade set screw 100'''. The blade set screw 100''' and the blade set screw receiving recess may be threaded so that the height of the blade set screw may be adjusted by a user, thereby adjusting the height of the blade 26'''. The other aspects of the fourth embodiment of the folding knife 20''' are similar to those of the first embodiment of the folding knife 20, are labelled with triple prime notation, and require no further discussion herein.

A method aspect of the present invention is for locking a folding knife 20 in an opened position. The method may comprise moving the blade 26 to the opened position, and moving the lock bar 30 to the engaged position so that a portion of the lock member 25 contacts a respective portion of the blade adjacent the lock member recess 53 to thereby define a contact point 88 between the lock member and the blade when the blade is in the opened position.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

The invention claimed is:

1. A folding knife comprising:

a handle;

a blade rotatably connected to said handle and moveable between an opened position and a closed position, said blade having a first lock member receiving recess defined by a bottom wall and first and second opposing sidewalls extending upwardly therefrom, and a second lock member receiving recess adjacent the first lock member receiving recess and defined by a bottom wall and a sidewall extending upwardly therefrom;

a lock bar pivotally connected to said handle and comprising a first lock member defined by a bottom wall and first and second sidewalls extending upwardly therefrom, and a second lock member adjacent the first lock member and defined by a bottom wall and a sidewall extending upwardly therefrom, said lock bar being movable between an engaged position and a disengaged position so that a portion of the first sidewall of the first lock member contacts a portion of the first sidewall of the first lock member recess to define a contact point between said lock bar and said blade when said blade is in the opened position and said lock bar is in the engaged position; and a lock pin connected to said handle adjacent said first and second lock members so that when said blade is in the opened position and said lock bar is in the engaged position, said lock pin contacts the second sidewall of said first lock member and the bottom wall of the second lock member receiving recess.

2. A folding knife according to claim 1 wherein the bottom wall and sidewall of said second lock member are spaced apart from the bottom wall and sidewall of the second lock member receiving recess when said lock bar is in the engaged position.

3. A folding knife according to claim 1 wherein the sidewall of the second lock member receiving recess is spaced apart from said lock pin when said blade is in the opened position and said lock bar is in the engaged position.

4. A folding knife according to claim 1 wherein the sidewall of the second lock member receiving recess is spaced apart from the sidewall of said second lock member when said blade is in the opened position and said lock bar is in the engaged position.

5. A folding knife according to claim 1 further comprising a blade connecting member connected to said handle; and wherein said blade has a blade connecting member passageway for receiving said blade connecting member to thereby rotatably connect said blade to said handle.

6. A folding knife according to claim 1 further comprising a lock bar connecting member connected to said handle; and wherein said lock bar has a lock bar connecting member passageway formed therein for receiving said lock bar connecting member to thereby pivotally connect said lock bar to said handle.

7. A folding knife according to claim 1 further comprising a lock bar spring member connected to said handle to engage a portion of said lock bar.

8. A folding knife according to claim 1 wherein the first lock member receiving recess is U-shaped; and wherein the second lock member receiving recess is L-shaped.

9. A folding knife according to claim 1 wherein said blade comprises an upper edge, and a sharpened lower edge.

10. A folding knife according to claim 9 wherein said sharpened lower edge is adjacent a lower edge of said lock bar when said blade is in the closed position.

11. A folding knife according to claim 1 wherein said handle has a distal portion and a proximal portion having a recess formed therein.

12. A folding knife comprising:

a handle having a distal portion and a proximal portion, the proximal portion having a recess formed therein;

a blade rotatably connected to the distal portion of said handle and moveable between an opened position and a closed position, said blade having an upper edge and a lower sharpened edge, a first lock member receiving recess defined by a bottom wall and first and second opposing sidewalls extending upwardly therefrom, and a second lock member receiving recess adjacent the first lock member receiving recess and defined by a bottom wall and a sidewall extending upwardly therefrom;

a lock bar pivotally connected to a medial portion of said handle and moveable between an engaged position and a disengaged position, said lock bar comprising a first lock member defined by a bottom wall and first and second sidewalls extending upwardly therefrom, and a second lock member adjacent the first lock member and defined by a bottom wall and a sidewall extending upwardly therefrom; and a lock pin connected to said handle adjacent said first and second lock members so that when said blade is in the opened position, said lock pin contacts the second sidewall of the first lock member and the bottom wall of the second lock member receiving recess;

wherein the bottom wall and sidewall of the second lock member are spaced apart from the bottom wall and sidewall of the second lock member receiving recess when said blade is in the opened position and said lock bar is in the engaged position; and wherein a portion of said lock bar contacts a portion of said blade adjacent the first lock member receiving recess to thereby define a contact point between the first lock member and said blade when said blade is in the opened position and said lock bar is in the engaged position.

13. A folding knife according to claim 12 wherein the sidewall of the second lock member receiving recess is spaced apart from the sidewall of the second lock member when said blade is in the opened position and said lock bar is in the engaged position.

14. A folding knife according to claim 12 wherein the sidewall of the second lock member receiving recess is spaced apart from said sidewall of said second lock member when said blade is in the opened position and said lock bar is in the engaged position.

15. A folding knife according to claim 12 further comprising a lock bar spring member connected to said handle to engage a portion of said lock bar.

16. A method for locking a folding knife in an opened position, the folding knife comprising a handle, a blade rotatably connected to the handle, the blade including a first lock member receiving recess defined by a bottom wall and first and second opposing sidewalls extending upwardly therefrom, and a second lock member receiving recess adjacent the first lock member receiving recess and defined by a bottom wall and a sidewall extending upwardly therefrom, a lock bar pivotally connected to the handle and moveable between an engaged position and a disengaged position, the lock bar comprising a first lock member defined by a bottom wall and first and second sidewalls extending upwardly therefrom, and a second lock member adjacent the first lock member and defined by a bottom wall and a sidewall extending upwardly therefrom, and a lock pin connected to the handle adjacent the first and second lock members so that when the blade is in the opened position, the lock pin contacts the second sidewall of the first lock member and the bottom wall of the second lock member receiving recess, and wherein the bottom wall and sidewall of the second lock member are spaced apart from the bottom wall and sidewall of the second lock member receiving recess when the blade is in the opened position and the lock bar is in the engaged position, the method comprising:

moving the blade to the opened position; and moving the lock bar to the engaged position so that a portion of the at least one lock member contacts a respective portion of the blade adjacent the at least one lock member recess to thereby define a contact point between the lock member and the blade when the blade is in the opened position.

17. A method according to claim 16 wherein the sidewall of the second lock member receiving recess is spaced apart from the lock pin when the blade is in the opened position and the lock bar is in the engaged position.

18. A method according to claim 16 wherein the sidewall of the second lock member receiving recess is spaced apart from the sidewall of the second lock member when the blade is in the opened position.

19. A method according to claim 16 wherein moving the lock bar to the locked position further comprises engaging the lock bar with a lock bar spring member connected to the handle.

* * * * *